US007573695B1

(12) United States Patent
Walker et al.

(10) Patent No.: US 7,573,695 B1
(45) Date of Patent: Aug. 11, 2009

(54) SNAPDOWN PREVENTION IN VOLTAGE CONTROLLED MEMS DEVICES

(75) Inventors: Andrew Walker, Mountain View, CA (US); Marc Hartranft, Scotts Valley, CA (US); Michael J. Duewake, Sunnyvale, CA (US); Gerald Murphy, Carrigrobane (IE); Kevin Gallagher, Midleton (IE)

(73) Assignee: Silicon Light Machines Corporation, Sunnyvale, CA (US)

( * ) Notice: Subject to any disclaimer, the term of this patent is extended or adjusted under 35 U.S.C. 154(b) by 136 days.

(21) Appl. No.: 11/977,875

(22) Filed: Oct. 26, 2007

(51) Int. Cl.
*H01T 23/00* (2006.01)

(52) U.S. Cl. ..... 361/207; 361/233

(58) Field of Classification Search ..... 361/207, 361/233, 271; 359/290, 291
See application file for complete search history.

(56) References Cited

U.S. PATENT DOCUMENTS 7,123,399 B2 * 10/2006 Gudeman et al. ..... 359/290
7,529,017 B1 * 5/2009 Walker et al. ..... 359/291

* cited by examiner

*Primary Examiner*—Danny Nguyen
(74) *Attorney, Agent, or Firm*—William E. Nuttle

(57) ABSTRACT

An architecture and method are provided for preventing snapdown in a voltage controlled MEMS device having a movable actuator with an actuator electrode coupled to a high voltage power supply (HVPS) through a drive circuit, the movable actuator suspended over a cavity electrode formed on a substrate and coupled to a common backplane supply (VssC). Generally, the circuit includes a number of first diodes coupled between the HVPS and the actuator electrode and/or the cavity electrode to provide a forward-biased path to transfer a positive charge to the HVPS when the accumulated charge exceeds a predetermined threshold. Preferably, the drive circuit further includes second diodes to provide a low impedance path to transfer a positives charge from the actuator electrode and/or the cavity electrode to a substrate ground when the accumulated charge results in or exceeds a predetermined threshold voltage. Other embodiments are also disclosed.

20 Claims, 7 Drawing Sheets

SNAPDOWN PREVENTION IN VOLTAGE CONTROLLED MEMS DEVICES

CROSS-REFERENCE TO RELATED APPLICATIONS

The present application claims the benefit of priority under 35 U.S.C. 119(e) to U.S. Provisional Patent Application Ser. No. 60/854,291 filed Oct. 25, 2006, entitled Snapdown Prevention In Voltage Controlled MEMS Devices; which application is hereby incorporated by reference.

TECHNICAL FIELD

The present invention relates generally to Micro-Electromechanical Systems (MEMS) devices, and more particularly to a circuit and method for preventing snapdown in a voltage controlled MEMS device.

BACKGROUND OF THE INVENTION

In many Micro-Electromechanical System or MEMS devices, electrostatic actuation is used to move micromechanical structures. For example, one type of MEMS device that uses electrostatic actuation is a ribbon-type spatial light modulator, such as a Grating Light Valve (GLV™) commercially available from Silicon Light Machines, Inc., of Sunnyvale, Calif. Referring to FIGS. 1A and 1B, a ribbon-type spatial light modulator 100 generally includes a number of ribbons 102*a*, 102*b*; each having a light reflective surface 104 supported over a surface 106 of a substrate 108. One or more of the ribbons 102*a* are deflectable through a gap or cavity 110 toward the substrate 108 to form an addressable diffraction grating with adjustable diffraction strength. The ribbons are 102*a* deflected towards the surface 106 of the substrate 108 by electrostatic forces when a voltage is applied between electrodes 112 in the deflectable ribbons 102*a* and base or cavity electrode(s) 114 formed in or on the substrate. The applied voltages are controlled by drive electronics (not shown in these figures), which may be integrally formed in or on the surface 106 of the substrate 108 below or adjacent to the ribbons 102. Light reflected from the movable ribbons 102*a* adds as vectors of magnitude and phase with that reflected from stationary ribbons 102*b* or a reflective portion of the surface 106 beneath the ribbons, thereby modulating light reflected from the SLM 100.

One chronic problem encountered with conventional electrostatically operated or voltage controlled MEMS devices is referred to as "snapdown." More specifically, when the voltage applied to an actuating electrode 112 in such device exceeds a critical value, roughly that required to deflect the membrane or movable ribbons 102*a* beyond one third of the initial gap 110, the attractive force between surfaces can exceed a linear restoring force of the membrane resulting in an unstable pull-in of the surfaces also called "snapdown". Moreover, atomic-level bonding forces frequently exceed the restoring force of the membrane structure, causing the membrane to remain "stuck" to the surface of the substrate permanently damaging the ribbon and rendering the MEMS device inoperable.

Accordingly, there is a need for a circuit and method that reduces or substantially eliminates snapdown in voltage controlled MEMS devices.

The present invention provides a solution to these and other problems, and offers further advantages over conventional MEMS devices and methods of operating the same.

BRIEF DESCRIPTION OF THE DRAWINGS

These and various other features and advantages of the present invention will be apparent upon reading of the following detailed description in conjunction with the accompanying drawings and the appended claims provided below, where:

DETAILED DESCRIPTION

The present invention is directed to an architecture and method for preventing snapdown in a voltage controlled Micro-Electromechanical System (MEMS) device.

In the following description, for purposes of explanation, numerous specific details are set forth in order to provide a thorough understanding of the present invention. It will be evident, however, to one skilled in the art that the present invention may be practiced without these specific details. In other instances, well-known structures, and techniques are not shown in detail or are shown in block diagram form in order to avoid unnecessarily obscuring an understanding of this description.

Reference in the description to "one embodiment" or "an embodiment" means that a particular feature, structure, or characteristic described in connection with the embodiment is included in at least one embodiment of the invention. The appearances of the phrase "in one embodiment" in various places in the specification do not necessarily all refer to the same embodiment. The term "to couple" as used herein may include both to directly connect and to indirectly connect through one or more intervening components.

Figure 1A:
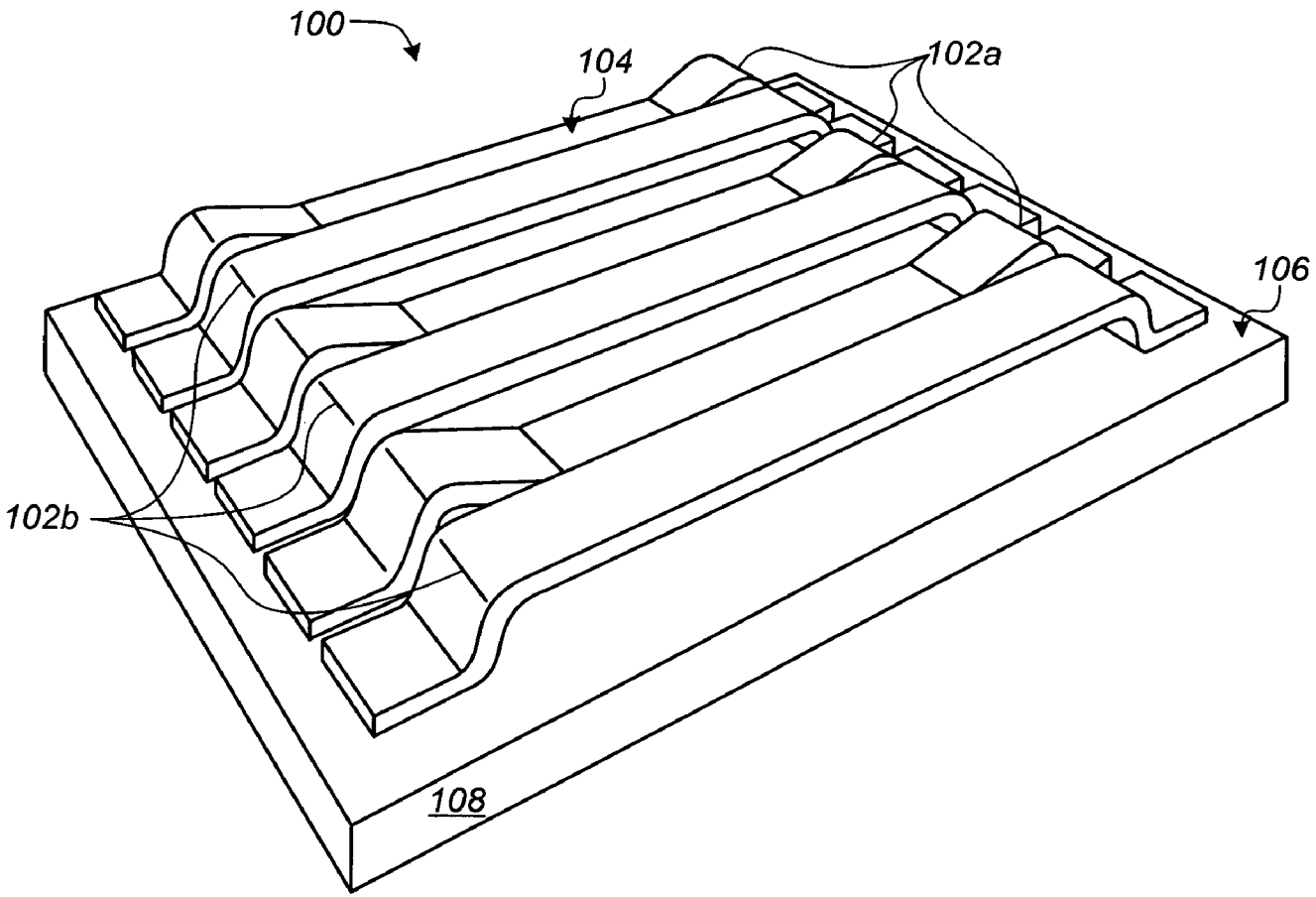
FIG. 1A (Prior Art)
FIG. 1A (Prior Art) is a perspective view of a ribbon-type spatial light modulator (SLM) for which a circuit according to an embodiment of the present invention is particularly useful.
Figure 1B:
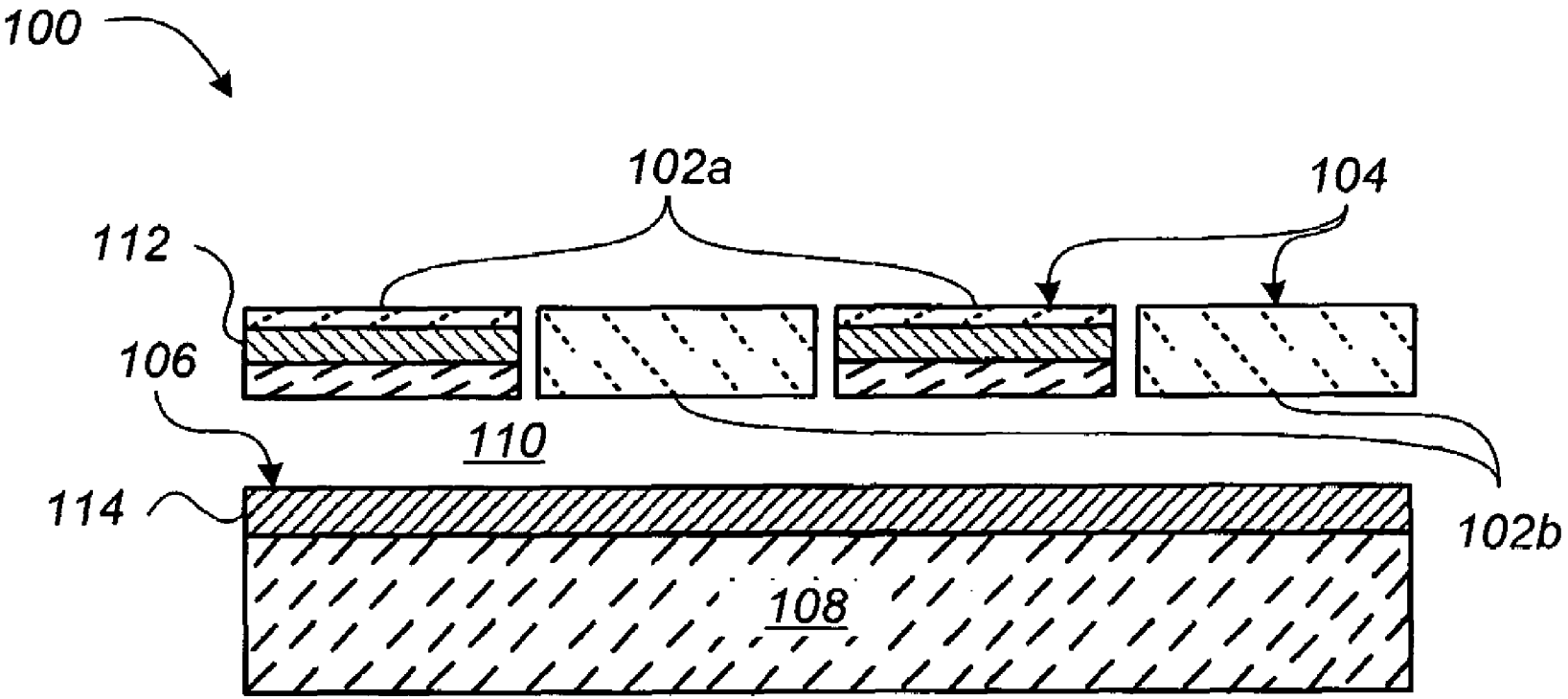
FIG. 1B (Prior Art)
FIG. 1B (Prior Art) is a block diagram illustrating a cross-sectional view of the ribbon-type SLM of FIG. 1A.

The circuit and method of the present invention for preventing snapdown in a voltage controlled MEMS devices make it particularly suitable for use with diffractive spatial light modulators (SLMs). One type of diffractive SLM is a ribbon-type spatial light modulator, such as a Grating Light Valve (GLV™) commercially available from Silicon Light Machines, Inc., of Sunnyvale, Calif. Referring to FIGS. 1A and 1B, a ribbon-type spatial light modulator 100 generally includes a number of ribbons 102*a*, 102*b*, each having a light reflective surface 104 supported over a surface 106 of a substrate 108. The surface 106 may or may not be reflective. One or more of the ribbons 102*a*, 102*b*, are deflectable toward the substrate 108 to form an addressable diffraction grating with adjustable diffraction strength. The ribbons 102*a* are deflected towards a base or cavity electrode 114 formed in or on the substrate 108 by electrostatic forces when differing voltages are applied between actuator or ribbon electrodes 112 in the deflectable ribbons 102*a* and the cavity electrode. Light reflected from the movable ribbons 102*a* adds as vectors of magnitude and phase with that reflected from stationary ribbons 102*b* or a reflective portion of the surface 106 beneath the ribbons, thereby modulating light reflected from the SLM 100. The voltages applied to the ribbon electrodes 112 and the cavity electrodes 114 are controlled by drive circuit or driver (not shown in this figure), which may be integrally formed in or on the surface 106 of the substrate 108 below or adjacent to the ribbons 102.

An architecture for a MEMS device and method of operating the same to prevent snapdown according to various embodiments of the present invention will now be described in detail with reference to FIGS. 2A through 5. For purposes of clarity, many of the details of MEMS fabrication and operation in general and ribbon-type SLMs in particular that are widely known and are not relevant to the present invention have been omitted from the following description.

Figure 2A:
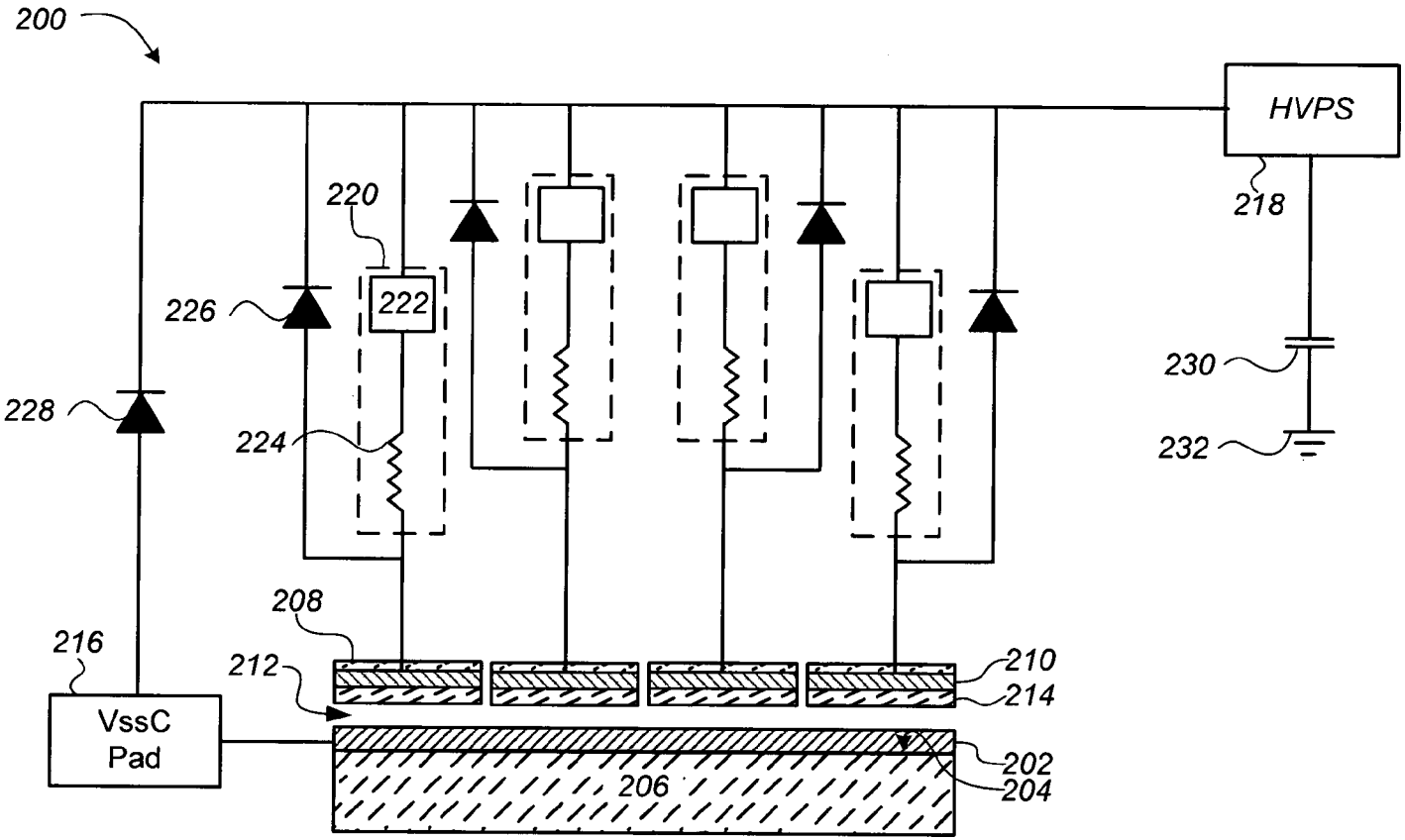
FIG. 2A is a block diagram illustrating a cross-sectional view of a ribbon-type MEMS device having coupled thereto a circuit according to an embodiment of the present invention to substantially prevent snapdown of movable ribbons of the device.

Referring to FIG. 2A, as described above the MEMS device 200 generally includes a cavity electrode 202 formed on a surface 204 of a substrate 206, and number of movable actuators or ribbons 208 each with an actuator electrode 210 suspended over the cavity electrode. The ribbons 208 separated from the cavity electrode 202 by a cavity 212 and by one or more dielectric layers 214 on a lower surface of the ribbon. The cavity electrode 202 is coupled to a common backplane or voltage supply (VssC) through a VssC pad 216 and the actuator electrodes of the ribbons 208 are coupled to a high voltage power supply (HVPS 218) through a number of drive circuits 220 or drivers to apply an electrostatic force between the cavity electrode and the actuator electrodes to move the number of movable actuators relative to the substrate 206.

Generally, the drive circuit 220 includes a number of active switching elements, such as a field effect transistor (FET 222) coupled to each actuator electrode 210 through a number of parallel and series resistors or resistance elements 224. The FETs 222 enable varying of charge applied to the actuator electrodes 210. The resistance elements 224 have a resistance selected in relation to a capacitance of the ribbon and cavity electrodes 210, 202 to provide an RC circuit having a desired response time for movement of the ribbons 208 during operation of the device 200.

In accordance with the present invention, the MEMS device 200 further includes a number of local diodes 226 coupled between the HVPS 218 and the actuator electrodes 210 to provide a forward-biased path to transfer a positive charge from the actuator electrodes to the HVPS when the accumulated charge exceeds a predetermined threshold, thereby substantially preventing snapdown of the movable actuators or ribbons 208. The local diodes 226 can include either discreet, deliberately placed diodes inside or outside the drive circuit 220 (as shown), or, where the drive circuit comprises a more complex CMOS drive circuit (not shown) including a number of active elements, the local diodes can include parasitic diodes formed from elements within the drive circuit.

Preferably, the MEMS device 200 further includes a cavity or VssC diode 228 coupled between the cavity electrode 202 and the HVPS 218 to provide a forward-biased path to transfer a positive charge from the cavity electrode to the HVPS when the accumulated charge exceeds a predetermined threshold. More preferably, the VssC diode 228 is from about 2 to about 100 times larger than the individual local diodes 226 coupled to the actuator electrodes 210 to enable conduction or transfer of the correspondingly larger charge accumulated on the cavity electrode 202.

Generally, the drive circuits 220 and/or other circuits formed on the substrate 206 and coupled to the HVPS 218 include a chip capacitance, schematically represented in FIG. 2A by capacitor 230 coupled between the HVPS and a chip or circuit ground 232, arising from parasitic capacitance of circuit elements and/or deliberate placement of discreet capacitors within the circuits. When the MEMS device 200 is not powered the local diodes 226 and the VssC diode 228 operate to enable the accumulated charge to flow into the chip capacitance 230, thereby eliminating snapdown caused by charge accumulated on the electrodes during manufacturing and subsequent handling of the device, and improving the yield of devices manufactured.

Optionally, in an embodiment not shown, the local diodes 226 can be coupled to the actuator electrodes 210 through the resistance elements 224 of the drive circuit 220 shown in FIG. 2A to provide a predetermined impedance when the local diodes are conducting and/or to limit current when charge is transferred from the ribbons 208.

Figure 2B:
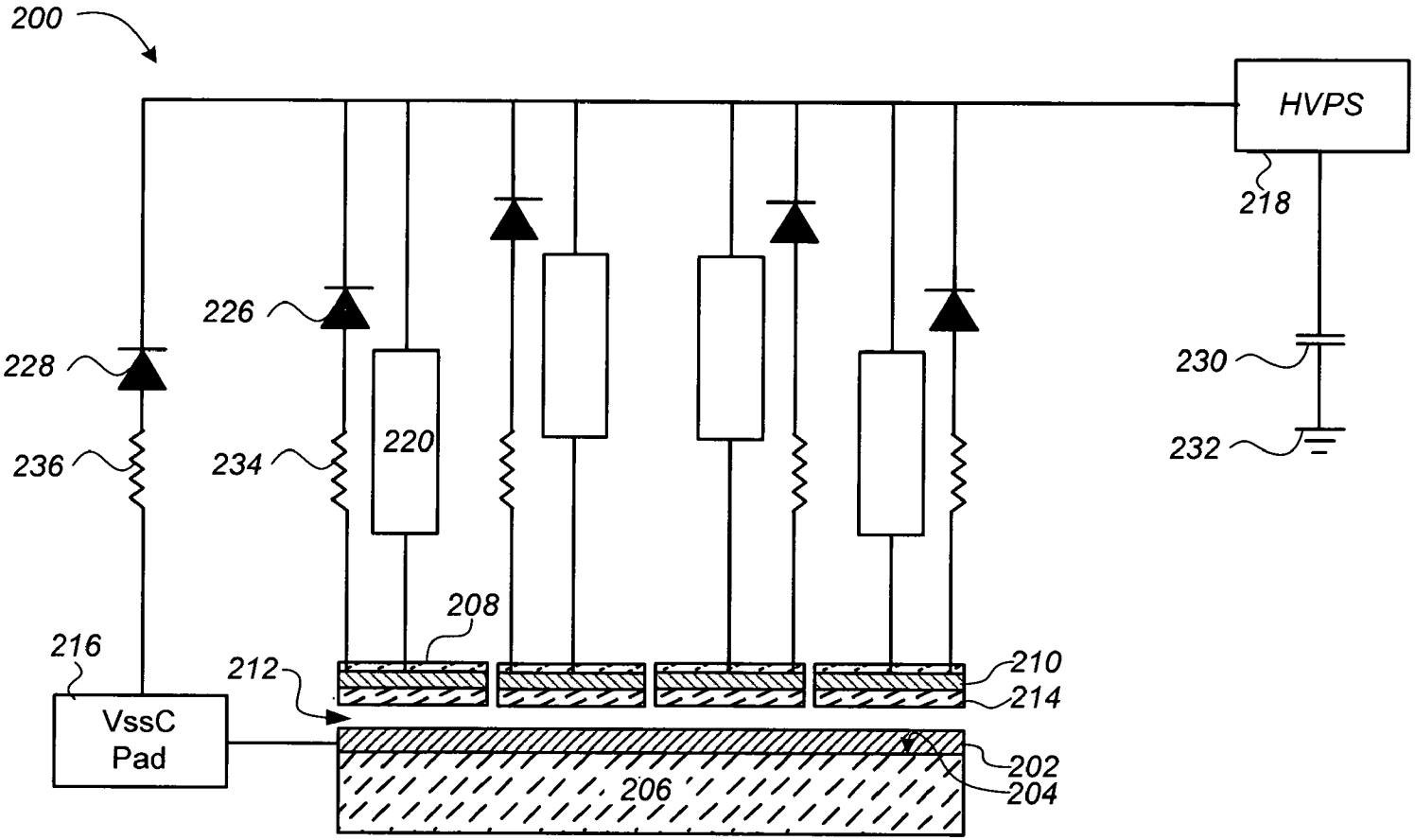
FIG. 2B is a block diagram illustrating a cross-sectional view of a ribbon-type MEMS device having coupled thereto a circuit according to another embodiment of the present invention to substantially prevent snapdown of movable ribbons of the device.

Alternatively, the local diodes 226 can be coupled directly to the actuator electrodes 210 or through a separate resistor or resistance element 234 as shown in FIG. 2B. While incurring some area penalty due to the fabrication of additional resistors, this embodiment has the advantage of enabling the resistors 234 to be tailored or sized to optimize the charge transfer characteristics of the snapdown prevention circuitry substantially without impacting the drive circuit 220 and normal operation of the MEMS device 200.

As also shown in FIG. 2B, the path coupling the cavity electrode 202 and the HVPS 218 can further include a resistor or resistance element 236 on either side of the VssC diode 228 or VssC pad 216. As noted above, this embodiment enables the charge transfer characteristics of the snapdown prevention circuitry to be optimized. That is the resistance element 236 has a resistance selected to allow a positive charge to be transferred to the HVPS 218 substantially without impacting normal operation of the MEMS device 200.

Figure 3A:
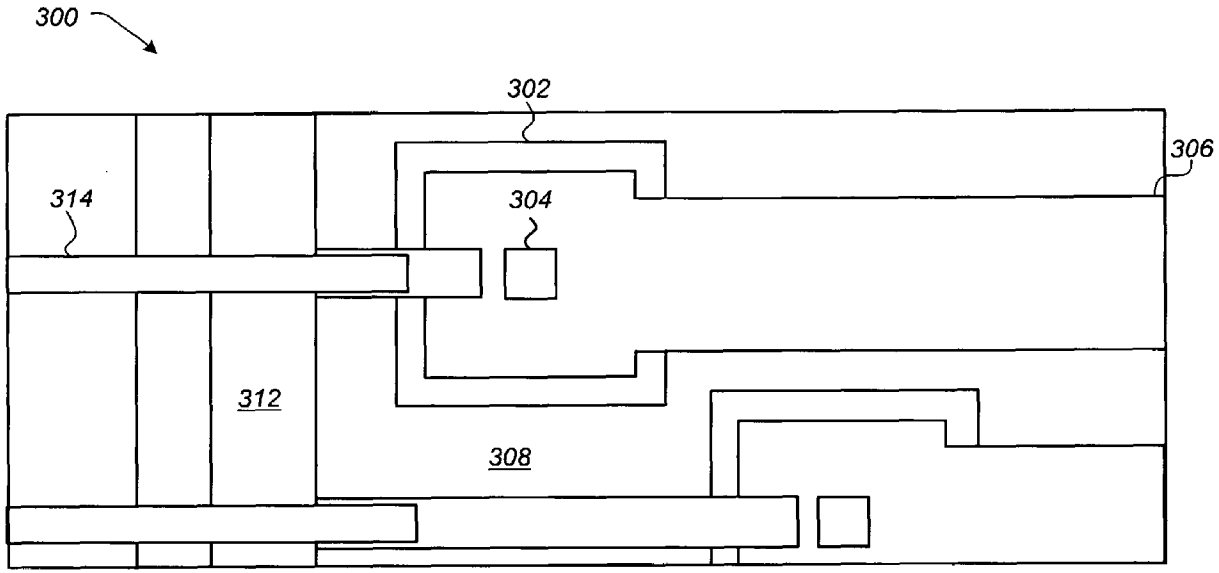
FIGS. 3A and 3B are diagrammatic views showing a layout of local diodes coupled to ribbons of a ribbon-type MEMS device to substantially prevent snapdown thereof according to an embodiment of the present invention.
Figure 3B:
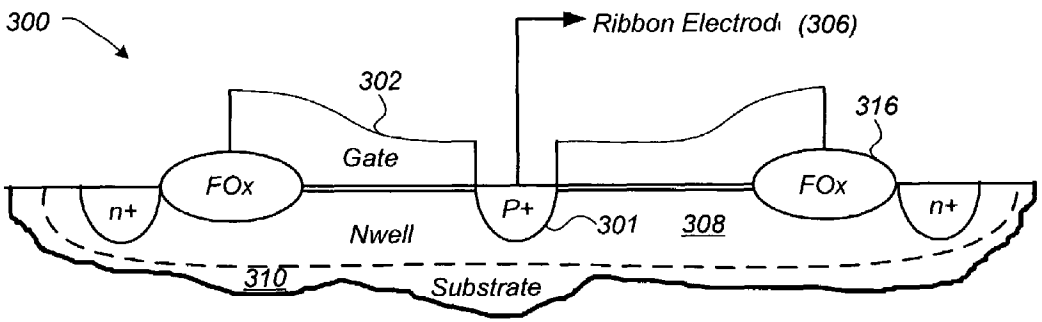
Figure 4:
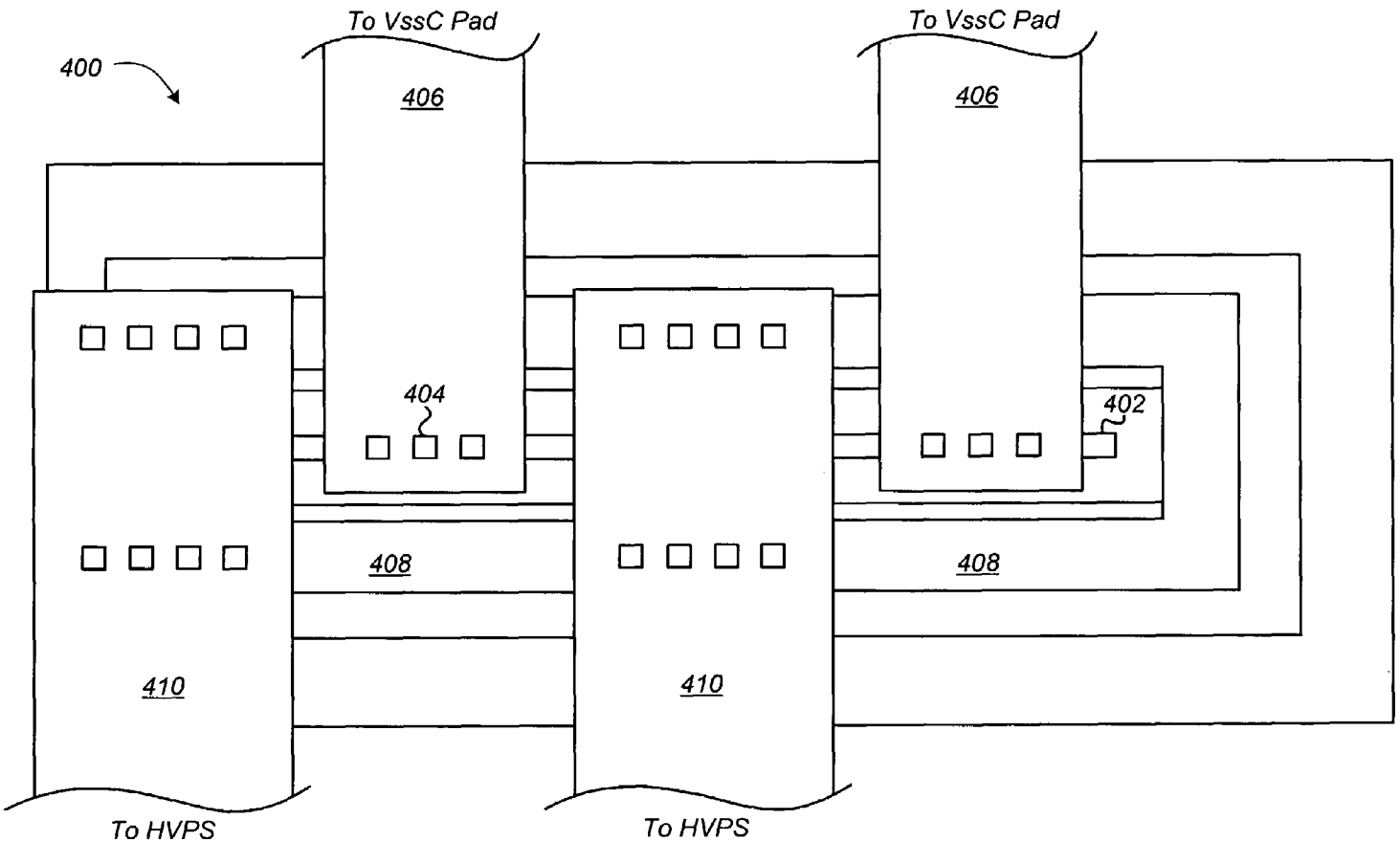
FIG. 4 is a diagrammatic, top-view showing another layout of a diode coupled to a cavity electrode of a ribbon-type MEMS device to substantially prevent snapdown of movable ribbons of the device according to another embodiment of the present invention.

In another aspect of the present invention, shown in FIGS. 3A and 3B, and in FIG. 4, the local diodes and the VssC diode can be gated diodes formed or fabricated having substantially no field edge to increase a breakdown voltage of the diodes beyond the typical 16 volts of the HVPS, which is the breakdown voltage of standard CMOS diodes. In particular, FIGS. 3A and 3B illustrate diagrammatic views of one possible layout for a local diode comprising a gated diode having substantially no field edge to increase a breakdown voltage thereof, while FIG. 4 shows one possible layout of a cavity or VssC diode.

Referring to FIGS. 3A and 3B, the local diode 300 includes an anode 301, shown here as a p+ diffusion, connected through a contact 304 to a ribbon or actuator electrode 306 of the ribbon (not shown). The gate 302 is formed in and completely surrounded by an Nwell 308 formed in the substrate 310. The cathode or Nwell 308 of the diode 300 is coupled to Vpwr (HVPS) through a polysilicon (poly) line 312. The diffusion 301 is also coupled to an active element, such as a drain extended n-channel field effect transistor (DE_NFET)

(not shown), in the drive circuit (not shown) and therefore to Vpwr (HVPS), through a metal line 314. Referring to FIG. 3B, it is seen that the gate 302 is isolated by field oxide (FOx) 316, and, because both the Nwell 308 and the gate are coupled to Vpwr (HVPS) inversion of the gate region is substantially eliminated, thereby further increasing the breakdown voltage of the diode 300.

FIG. 4 shows a similar arrangement for a number of VssC diodes 400 including an anode 402, shown here as a p+ diffusion, connected through contacts 404 to VssC pads 406. The cathode or Nwell 408 of the diode 400 is coupled to Vpwr (HVPS) through metal lines 410.

Figure 5:
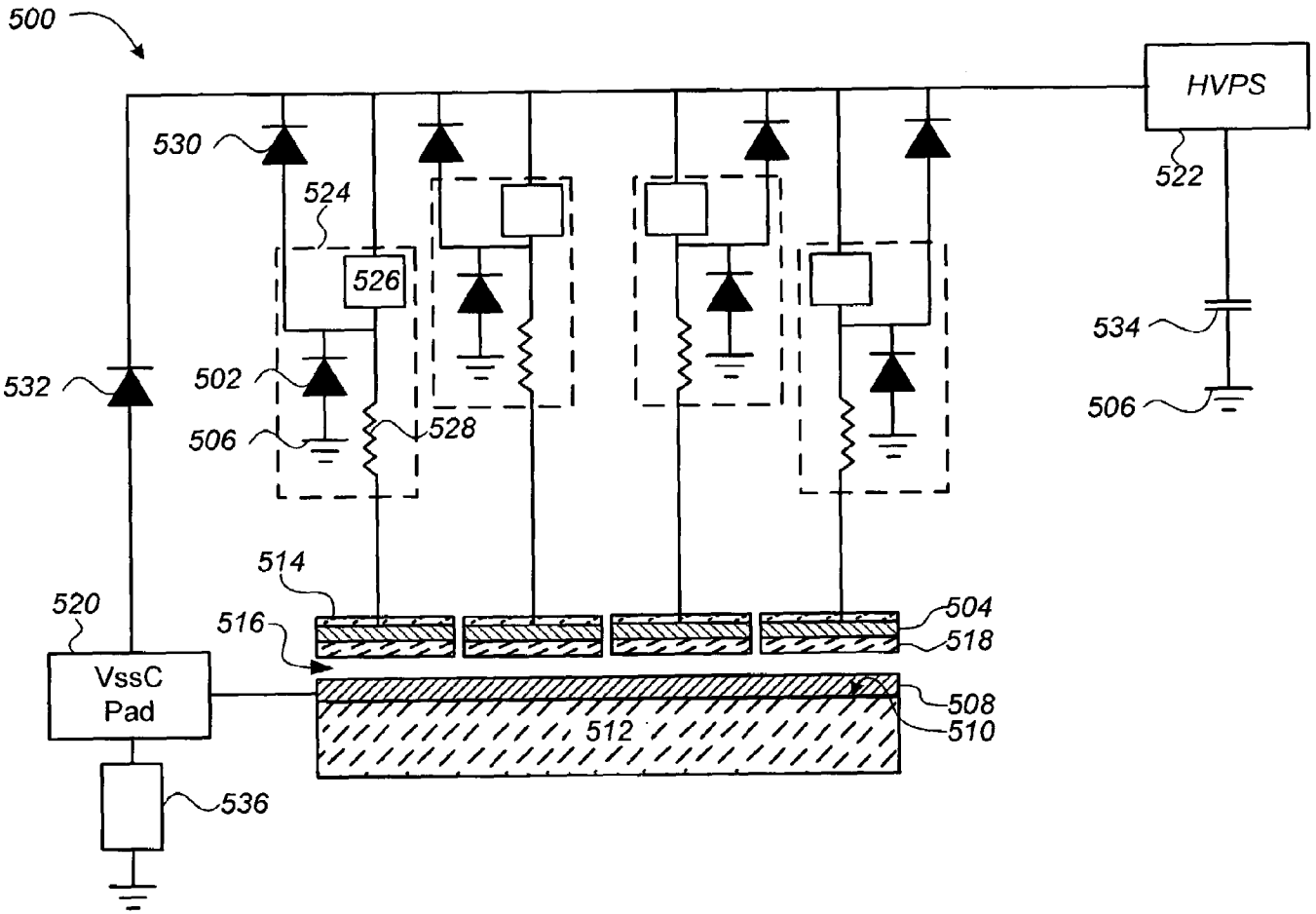
FIG. 5 is a block diagram illustrating a cross-sectional view of a ribbon-type MEMS device having coupled thereto a circuit according to yet another embodiment of the present invention to substantially prevent snapdown of movable ribbons of the device.

In yet another aspect of the present invention, shown in FIG. 5, the MEMS device 500 can further include a number of second diodes 502 coupled between the actuator electrodes 504 and a substrate ground 506, to provide a low impedance path to transfer a negative charge from the actuator electrodes to the substrate ground when the accumulated charge results in or exceeds a predetermined threshold voltage. For negative charge, the path is forward biased.

Referring to FIG. 5, as described above the MEMS device 500 generally includes a cavity electrode 508 formed on a surface 510 of a substrate 512, and number of movable actuators or ribbons 514 each with an actuator electrode 504 suspended over the cavity electrode. The ribbons 514 are separated from the cavity electrode 508 by a cavity 516 and by one or more dielectric layers 518 on a lower surface of the ribbon. The cavity electrode 508 is coupled to a common backplane supply (VssC) through a VssC pad 520 and the actuator electrodes 504 of the ribbons 514 are coupled to HVPS 522 through a number of drive circuits 524, each including a number of active switching devices, such as an FET 526, and a resistor or resistance element 528.

Preferably in accordance with the present invention, the MEMS device 500 further includes a number of local diodes 530 and a VssC diode 532. More preferably, as described above the local diodes 530 can also include either discreet, deliberately placed diodes inside or outside the drive circuit 524, or parasitic diodes formed from elements in the drive circuit. The local diodes 530 are coupled between the HVPS 522 and the actuator electrodes 504 to provide a forward-biased path to transfer a positive charge from the actuator electrodes to the HVPS and/or a chip capacitance, schematically represented here by capacitor 534, when the accumulated positive charge exceeds a predetermined threshold. The VssC diode 532 is coupled between the HVPS 522 and the VssC pad 520 to provide a forward-biased path to transfer a positive charge from the cavity electrode 508 to the HVPS and/or capacitor 534.

As with the local diodes 530 the second, negative charge transfer diodes 502 can also include either discreet, deliberately placed diodes inside or outside the drive circuit 524, or parasitic diodes formed from elements in the drive circuit. For example, in those embodiments in which the drive circuit 524 includes a number of drain extended N-channel FETs (DE_NFETs) formed within an Nwell in a P-type substrate as switching elements, and having drains coupled to drive the actuator electrodes 504 through the Nwell, the second diodes 502 can include parasitic diodes intrinsically formed between the Nwell and the substrate. The geometrical dimensions of the Nwell as well as the dimensions and electrical characteristics of the DE_NFET formed therein can be tailored to provide second, negative charge transfer diodes 502 having the desired electrical properties. For example, the well could be formed having a larger area to increase diode size or area.

Preferably, the MEMS device 500 further includes an (ESD) clamp 536, such as a reverse biased diode or a diode connected FET, coupled between the cavity electrode 508 and the substrate ground 506, sized and doped to provide a low impedance path to transfer a positive charge from the cavity electrode to the substrate ground when the accumulated charge results in or exceeds a predetermined threshold voltage. For negative charge, the path is forward biased.

Although not shown it will be appreciated by those skilled in the art that the second or negative charge transfer diodes 502 can be coupled to the actuator electrodes 504 through a separate charge transfer path independent of the path coupling the drive circuit 524 to the actuator electrodes, and similar to that shown in FIG. 3B. This separate path may or may not further include a number of separate resistors or resistance elements to optimize the charge transfer characteristics of the snapdown prevention circuitry substantially without impacting the drive circuit 524 and normal operation of the MEMS device 500. It will further be appreciated that this path coupling the second or negative charge transfer diodes 502 to the actuator electrodes 504 and the separate resistors or resistance elements can be shared with the path and resistors or resistance elements coupling the local diodes 530 to the actuator electrodes 504.

The advantages of the snapdown prevention circuit and method of the present invention over previous or conventional approaches include: (i) substantially eliminates snapdown during manufacturing, subsequent product handling, and in operation of a voltage controlled MEMS device, thereby improving yield and extending operating life of the device; (ii) elimination of the need for special handling during manufacturing, subsequent product handling; (iii) elimination of the need for special coatings and/or structures on the ribbon and/or substrate surfaces to reduce sticking of snapped down ribbons; and (iv) compatible with existing designs and process flows.

The foregoing description of specific embodiments and examples of the invention have been presented for the purpose of illustration and description, and although the invention has been described and illustrated by certain of the preceding examples, it is not to be construed as being limited thereby. They are not intended to be exhaustive or to limit the invention to the precise forms disclosed, and many modifications, improvements and variations within the scope of the invention are possible in light of the above teaching. It is intended that the scope of the invention encompass the generic area as herein disclosed, and by the claims appended hereto and their equivalents. The scope of the present invention is defined by the claims, which includes known equivalents and unforeseeable equivalents at the time of filing of this application.

What is claimed is:

1. A voltage controlled Micro-Electromechanical System (MEMS) device comprising:

a cavity electrode formed on a surface of a substrate and coupled to a common backplane supply voltage (VssC) pad;

a number of movable actuators each with an actuator electrode suspended over the cavity electrode and separated therefrom;

a drive circuit through which the actuator electrodes of the number of movable actuators are coupled to a high voltage power supply (HVPS) to apply an electrostatic force between the cavity electrode and the actuator electrodes to move the number of movable actuators relative to the substrate; and a number of first diodes coupled between the HVPS and the actuator electrodes, the number of first diodes connected to provide forward-biased paths to transfer a positive charge from the actuator electrodes when the accumulated charge exceeds a predetermined threshold, whereby snapdown of the movable actuators is substantially prevented.

2. A MEMS device according to claim 1, wherein the number of first diodes includes a number of discrete diodes, and wherein each of the number of movable actuators has one of the number of discrete diodes coupled to the actuator electrode thereof.

3. A MEMS device according to claim 2, wherein the number of first diodes further include a VssC diode coupled between the HVPS and the VssC pad to provide a forward-biased path to transfer a positive charge from the cavity electrode when the accumulated charge exceeds a predetermined threshold.

4. A MEMS device according to claim 3, wherein the VssC diode is larger than the discrete diodes coupled to each of the number of movable actuators.

5. A MEMS device according to claim 2, wherein the number of first diodes are formed having substantially no field edge to increase a breakdown voltage thereof.

6. A MEMS device according to claim 1, wherein the drive circuit comprises a number of field effect transistors (FETs) having multiple doped wells, at least one FET coupled to each of the actuator electrodes, and wherein the number of first diodes comprises diodes intrinsically formed by junctions between the wells of the FETs.

7. A MEMS device according to claim 1, wherein circuits formed on the substrate and coupled to the HVPS comprises a chip capacitance, and wherein the number of first diodes operate when the HVPS is not powered by enabling the accumulated charge to flow into the chip capacitance.

8. A MEMS device according to claim 1, wherein the forward-biased paths further comprise resistors through which charge is transferred from the actuator electrodes to the HVPS.

9. A MEMS device according to claim 1, further comprising a number of second diodes coupled between the actuator electrodes and a substrate ground, the number of second diodes connected to provide a low impedance path to transfer a negative charge from the actuator electrodes to the substrate ground when the accumulated charge results in or exceeds a predetermined threshold voltage.

10. A MEMS device according to claim 9, wherein the drive circuit comprises a number of field effect transistors (FETs) having multiple doped wells, at least one FET coupled to each of the actuator electrodes, and wherein the number of first diodes comprises diodes intrinsically formed by junctions between the wells of the FETs.

11. A MEMS device according to claim 9, further comprising an electrostatic discharge (ESD) element coupled between the VssC pad and a substrate ground to transfer a negative charge from the cavity electrode to the substrate ground when the accumulated charge results in or exceeds a predetermined threshold voltage.

12. A method for preventing snapdown in a voltage controlled Micro-Electromechanical System (MEMS) devices having a number of movable actuators each with an actuator electrode coupled to a high voltage power supply (HVPS) through a drive circuit, said movable actuators suspended over a cavity electrode coupled to a common backplane voltage supply (VssC) pad, the method comprising steps of:

providing a first forward-biased path between the actuator electrodes and the cavity electrodes and the HVPS; and transferring a positive charge from at least one of the actuator electrodes or the cavity electrode to the HVPS through first forward-biased path when the accumulated charge exceeds a predetermined threshold voltage.

13. A method according to claim 12, wherein circuits formed on the substrate and coupled to the HVPS comprises a chip capacitance, and wherein the step of transferring a positive charge comprises the step of transferring the accumulated charge into the chip capacitance when the HVPS is not powered.

14. A method according to claim 12, wherein the step of providing a forward-biased path comprises the step of providing a number of first diodes coupled between the VssC pad and the actuator electrodes and the HVPS.

15. A method according to claim 14, wherein the number of first diodes includes a number of discrete diodes, and wherein the VssC pad and each of the actuator electrodes has one of the number of discrete diodes coupled thereto.

16. A method according to claim 14, wherein the drive circuit comprises a number of field effect transistors (FETs) having multiple doped wells, at least one FET coupled to each of the actuator electrodes, and wherein the number of first diodes comprises diodes intrinsically formed by junctions between the wells of the FETs.

17. A method according to claim 12, further comprising steps of:

providing a second forward-biased path between the actuator electrodes and the cavity electrodes and a substrate ground; and transferring a negative charge from at least one of the actuator electrodes or the cavity electrode to the substrate ground through second forward-biased path when the accumulated charge exceeds the predetermined threshold voltage.

18. A spatial light modulator (SLM) comprising:

a cavity electrode formed on a surface of a substrate and coupled to a common backplane supply voltage (VssC) pad;

a number of movable actuators suspended over the cavity electrode and separated therefrom, each of the movable actuators having a reflective surface and an actuator electrode;

a drive circuit through which the actuator electrodes of the number of movable actuators are coupled to a high voltage power supply (HVPS) to apply an electrostatic force between the cavity electrode and the actuator electrodes to move the number of movable actuators relative to the substrate; and a number of first diodes coupled between the HVPS and the actuator electrodes, and between the HVPS and the VssC pad, the number of first diodes connected to provide forward-biased paths to transfer a positive charge from at least one of the actuator electrodes or the cavity electrode to the HVPS when the accumulated charge exceeds a predetermined threshold, whereby snapdown of the movable actuators is substantially prevented.

19. A SLM according to claim 18, wherein the drive circuit comprises a number of field effect transistors (FETs) having multiple doped wells, at least one FET coupled to each of the actuator electrodes, and wherein the number of first diodes comprises diodes intrinsically formed by junctions between the wells of the FETs.

20. A SLM according to claim 19, wherein circuits formed on the substrate and coupled to the HVPS comprises a chip capacitance, and wherein the number of first diodes operate when the HVPS is not powered by enabling the accumulated charge to flow into the chip capacitance.

* * * * *